US005673600A

United States Patent [19]

Yanagi et al.

[11] Patent Number: 5,673,600

[45] Date of Patent: Oct. 7, 1997

[54] SCREWDRIVER HAVING PLURAL KINDS OF DRIVER PINS

[75] Inventors: Nobuyuki Yanagi; Masato Yamauchi, both of Niigata, Japan

[73] Assignee: NEC Corporation, Tokyo, Japan

[21] Appl. No.: 621,635

[22] Filed: Mar. 26, 1996

[30] Foreign Application Priority Data

Mar. 29, 1995 [JP] Japan ..... 7-071291

[51] Int. Cl.[6] ..... B25G 1/08

[52] U.S. Cl. ..... 81/490; 81/439; 81/177.4

[58] Field of Search ..... 81/177.4, 439, 81/490

[56] References Cited

U.S. PATENT DOCUMENTS 2,635,661 4/1953 Egan ..... 81/490
4,572,038 2/1986 Graham ..... 81/490 X
4,716,795 1/1988 Corona et al. ..... 81/490 X
5,337,637 8/1994 Bih-Lien ..... 81/439

*Primary Examiner*—James G. Smith

[57] ABSTRACT

A screwdriver has a plurality of driver pins or different kinds where the shapes of the point portions are different from one another, and connecting shafts connected to the driver pins through universal joints, respectively. The driver pins are provided with spline grooves. Actuating shafts are also connected to the connecting shafts through universal joints, respectively. These members are housed within a cover and are guided upward and downward through the interior walls of the cover. The respective actuating shafts are upwardly energized by springs. Only one of the second shafts is selected and pushed down against the energizing means by a solid cam. The cover is provided with a single hole at a bottom end of the cover, and the single hole allows only one of the driver pins to pass through. The surfaces of the single hole are provided with a spline which is engageable with the longitudinal spline grooves of each of the driver pins.

14 Claims, 3 Drawing Sheets

SCREWDRIVER HAVING PLURAL KINDS OF DRIVER PINS

BACKGROUND OF THE INVENTION

1. Field of the Invention

The present invention relates generally to screwdrivers used for tightening small screws, and more particularly to screwdrivers which can be used for tightening small screws of various kinds where the shapes of the grooves in the screw heads are different.

2. Description of the Related Art

A conventional screwdriver used for tightening small screws can be used only for tightening small screws of one kind where the shapes of the grooves in the screw heads are the same, because the point portion of the screwdriver is constant. For small screws of various kinds where the shapes of the grooves in the screw heads are different, a variety of screwdrivers having point portions corresponding in shape to the respective screw grooves are needed.

As described above, one kind of screwdriver corresponds to the groove shape of the screw head of one kind and therefore a variety of screwdrivers are needed or small screws of various kinds where the shapes of the grooves in the screw heads are different. Therefore, in a case where small screws of various kinds with different screw grooves are used, there is the drawback and inconvenience that a screwdriver must be chosen which has a point portion corresponding to the groove shape of a screw to be used.

SUMMARY OF THE INVENTION

An object of the present invention is to provide a screwdriver which is capable of tightening small screws of various kinds where screw grooves vary in shape.

To achieve this end, there is provided a screwdriver comprising a plurality of driver pins of different kinds where the shapes of the point portions are different from one another, and a plurality of connecting shafts connected to the plurality of driver pins through a first set of universal joints, respectively. The driver pins are provided with spline grooves on the outside surfaces thereof. The screwdriver of the present invention further comprises a plurality of actuating shafts connected to the plurality of connecting shafts through a second set of universal joints, respectively. These members are housed within a cover and are guided upward and downward through the interior walls of the cover. The respective actuating shafts are upwardly energized by energizing means, for example, springs. Only one of the second shafts is selected and pushed down against the energizing means by a solid cam. The cover is provided with a single hole located at a bottom end of the housing, and the single hole allows only one of the driver pins to pass through. The surfaces of the single hole are provided with a spline which is engageable with the longitudinal spline grooves of each of the driver pins.

More specifically, a changing dial is freely rotatably mounted on the cover and a changing switch is movably provided in the changing dial. The changing switch is normally moved away from the solid cam, and when pushed down, the switch engages with the solid cam so that the solid cam is rotated together with the changing dial. The cover is provided with a hole which allows only one of the driver pins to pass through. The inside walls on the hole are provided with an insert which has a spline groove. Each of the driver pins is provided with a spline engageable with the spline groove of the insert.

With this arrangement, a desired driver pin can be selected from the driver pins and can be projected downward from the cover. Accordingly, the present invention has the advantage that a single screwdriver can cope with small screws of various kinds having screw grooves of different shapes.

In a preferred form of the present invention, the aforementioned solid cam has a top surface and an under surface, the under surface being constituted by a first surface where a distance from the top surface is relatively large, a second surface where a distance from the top surface is relatively small, and a third surface which smoothly connects the first and second surfaces together. One of the actuating shafts is pushed down by the first surface, and the remaining actuating shafts are held by the second surface.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENT

Figure 1:
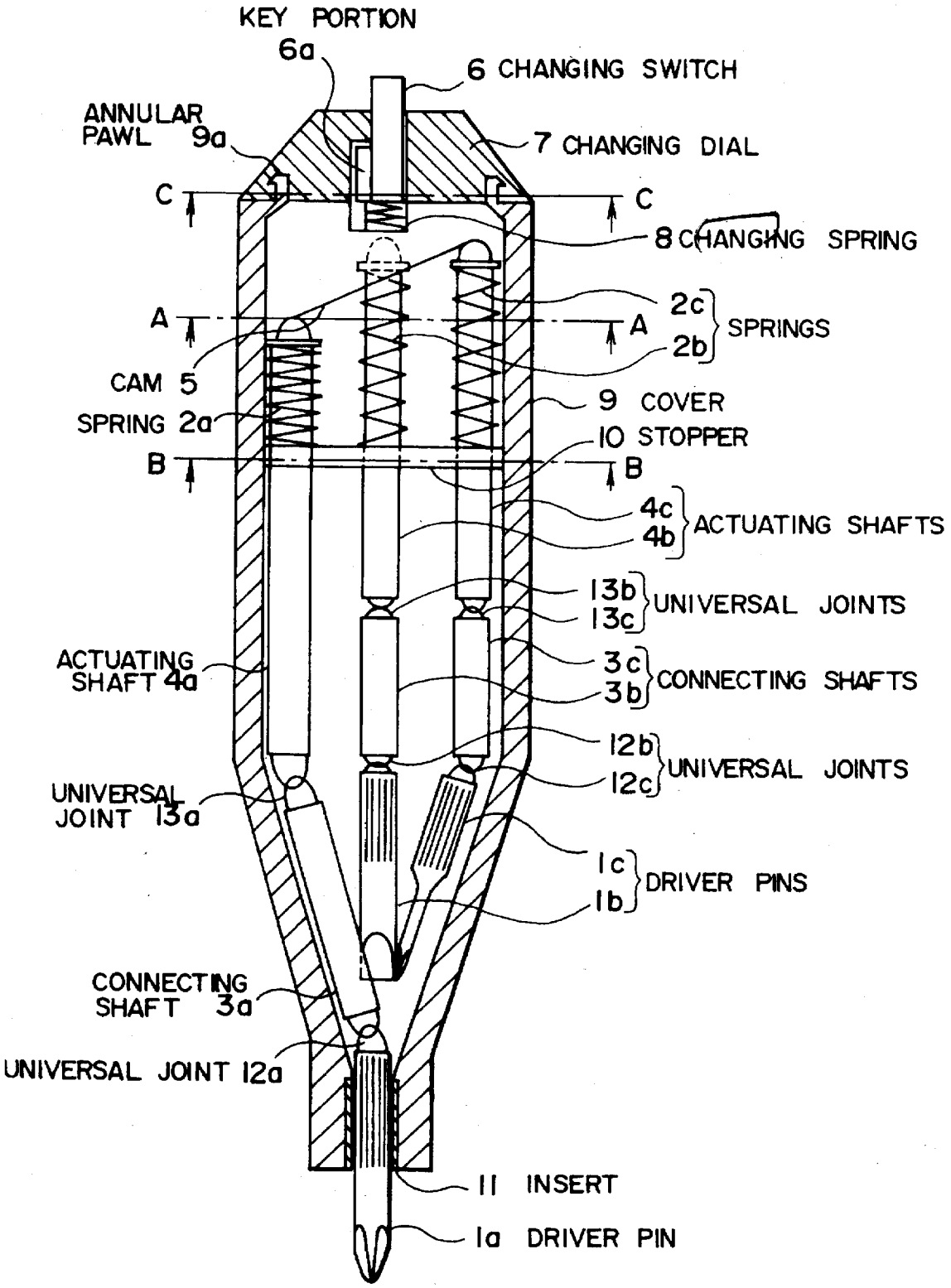
FIG. 1 is a longitudinal sectional view showing a screwdriver according to an embodiment of the present invention.

Referring to FIG. 1, there is shown a preferred embodiment of a screwdriver in accordance with the present invention. The screwdriver has driver pins 1*a*, 1*b*, and 1*c* of three kinds where the shapes of the point portions are different. The screwdriver is constructed such that a desired one of the three driver pins 1*a*, 1*b*, and 1*c* is selectively chosen to project downward from the lower end of a cover 9 by rotating a changing dial 7 provided on top of the cover 9.

The driver pins 1*a*, 1*b*, and 1*c* are connected to connecting shafts 3*a*, 3*b*, and 3*c* by universal joints 12*a*, 12*b*, and 12*c*, respectively. The connecting shafts 3*a*, 3*b*, and 3*c* are connected to actuating shafts 4*a*, 4*b*, and 4*c* by universal joints 13*a*, 13*b*, and 13*c*, respectively. The top portions of the actuating shafts 4*a*, 4*b*, and 4*c* are brought into contact with the bottom surface of a cam 5 by means of springs 2*a*, 2*b*, and 2*c*, respectively. The cam 5 is rotated by rotation of the changing dial 7. With the rotation of this cam 5, the actuating shafts 4*a*, 4*b*, or 4*b* making contact with the pushing-down surface 5*b* (details will be described later) of the bottom surface of the cam 5 is pushed down, and the driver pin 1*a*, 1*b*, or 1*c*, connected to that shaft, is projected downward from the lower end of the cover 9.

On the inner peripheral portion of the cylindrical cover 9 where the lower end portion is narrow, a stopper 10 is fixed to the portions lightly above the longitudinal central portion of the cover 9. The stopper 10, as shown in FIG. 2B, is provided with three holes 14*a*, 14*b*, and 14*c* into which the actuating shafts 4*a*, 4*b*, and 4*c* are inserted. The lower ends of the springs 2*a*, 2*b*, and 2*c* are supported by the material surrounding these three holes 14*a*, 14*b*, and 14*c*. Thus, the stopper 10 has both a function of guiding the up and down motion of the actuating shafts 4a, 4b, and 4c and a function of holding the springs 2a, 2b, and 2c.

The lower end of the cover 9 is provided with a hole through which the driver pin 1a, 1b, or 1c can pass. On this hole, an insert 11 is inserted. The inner periphery of the insert 11 is provided with a spline groove. On the other hand, the upper outer periphery of each of the driver pins 1a, 1b, and 1c is provided with a spline, which is engageable with the spline groove formed in the inner periphery of the insert 11. Thus, the spline of the driver pin 1a, 1b, or 1c, pushed down by the cam 5, meshes with the spine groove of the insert 1, and consequently, the driver pin 1a, 1b, or 1c can be rotated integrally with the cover 9.

Figure 2A:
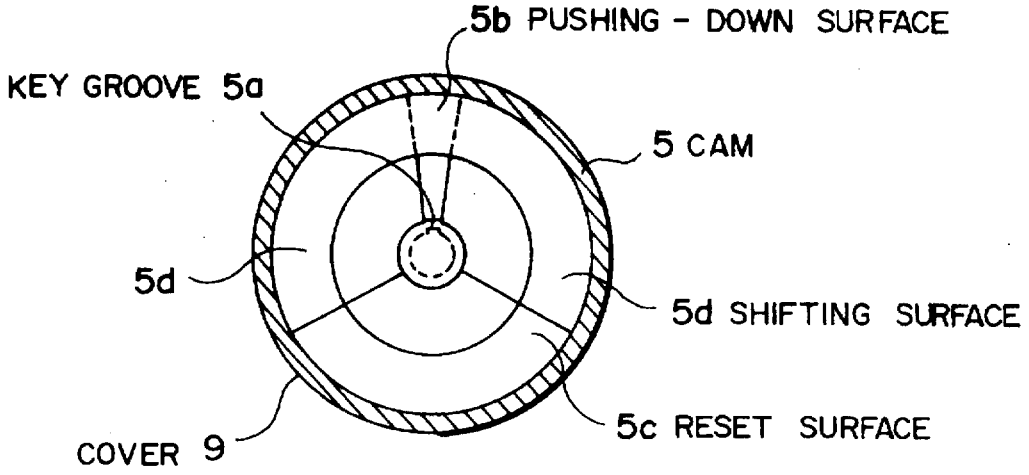
FIG. 2A is a cross sectional view of the screwdriver taken substantially along line A—A of FIG. 1.
Figure 2B:
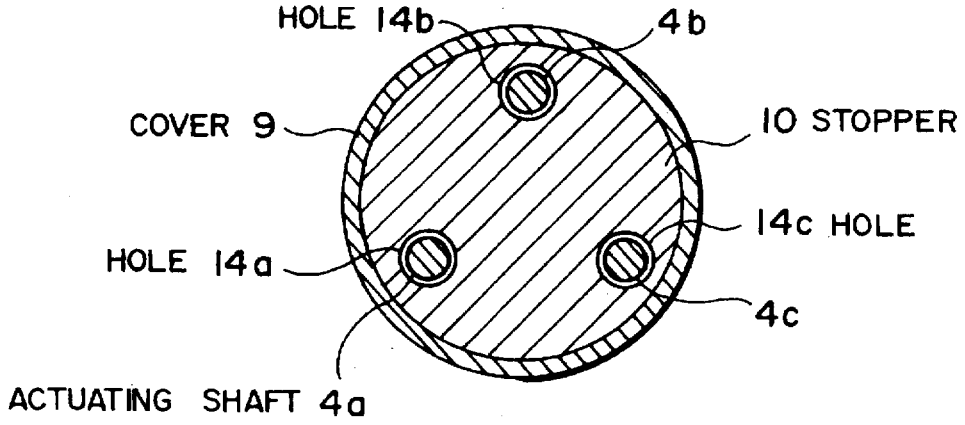
FIG. 2B is a cross sectional view of the screwdriver taken substantially along line B—B of FIG. 1.
Figure 2C:
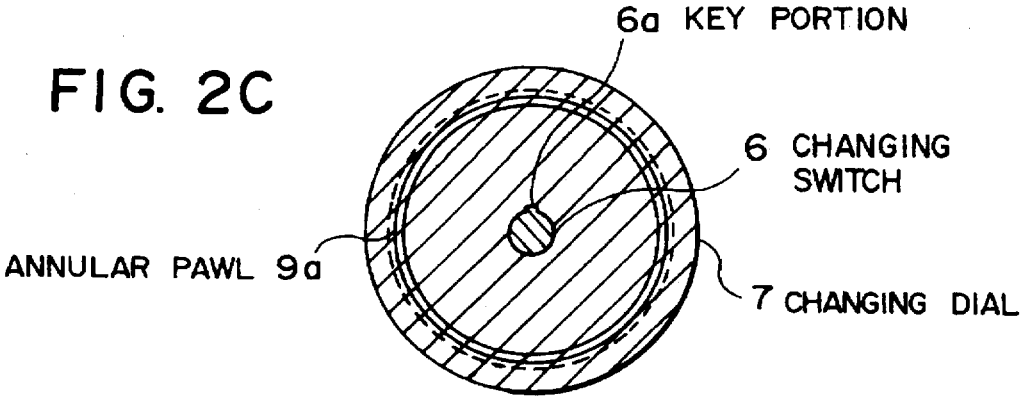
FIG. 2C is a cross sectional view of the screwdriver taken substantially along line C—C of FIG. 1.

An annular pawl 9a, as shown in FIGS. 1 and 2C, extends upward from the top of the cover 9 and is fitted into a pawl groove provided in the changing dial 7 mounted on the cover 9. Therefore, the changing dial 7 is freely rotatable on the cover 9 along the pawl 9a.

The central portion of the changing dial 7, where the section is a trapezoid, is provided with a hole into which the changing switch 6 is inserted, and the upper end portion of the changing switch 6 is projected upward from the hole of the changing dial 7. The lower portion of the changing switch 6, as shown in FIGS. 1 and 2C, is provided with a key portion 6a. The portion of the cam 5 corresponding to the changing switch 6 is provided with a hole into which a changing spring 8 is inserted for pushing up the changing switch 6. Therefore, the changing switch 6 is pushed upward by the changing spring 8, then the top surface 4 of the key portion 6a of the changing switch 6 is brought into contact with the upper end surface of the key groove provided in the changing dial 7 and is stopped, and the upper end portion of the changing switch 6 is projected above the changing dial 7.

At this time, the under surface of the changing switch 6 is moved away from the top surface of the cam 5 provided in the cover 9, and consequently, in this state the changing dial 7 can be freely rotated.

Figure 3A:
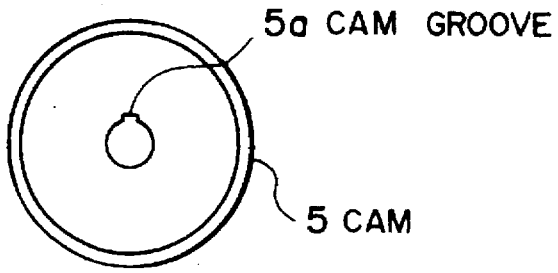
FIG. 3A is a plan view of the cam in FIG. 1.
Figure 3B:
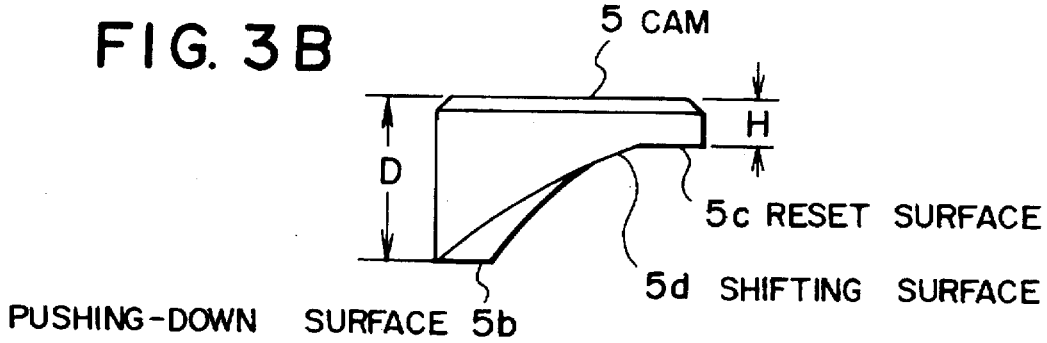
FIG. 3B is a side view of the cam in FIG. 1.
Figure 3C:
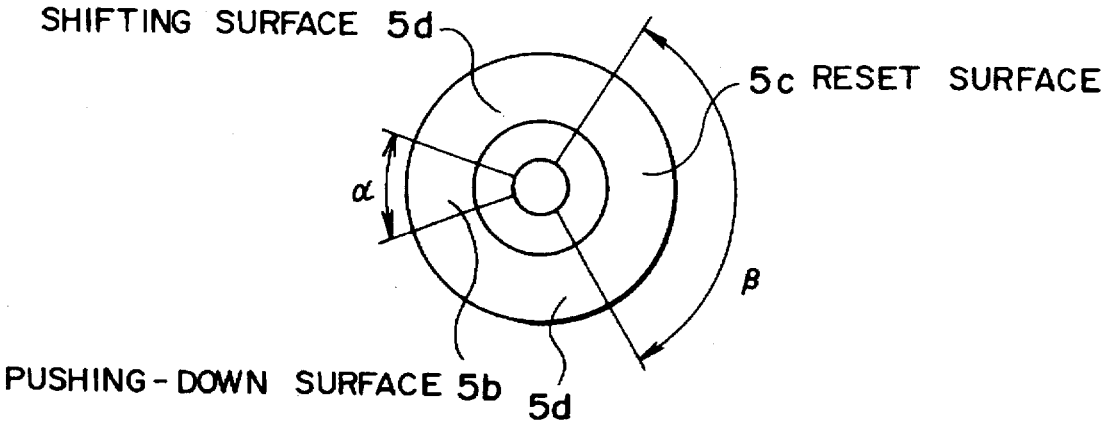
FIG. 3C is a bottom view of the cam in FIG. 1.

A key groove 5a, as shown in FIG. 2A, is provided in the cam 5 at the position corresponding to the key portion 6a of the changing switch 6. Therefore, if the changing switch 6 is pushed down against the changing spring 8, then the key portion 6a of the changing switch 6 will be inserted into the key groove 5a of the cam 5. If, in this state, the changing dial 7 is rotated, the cam 5 will be rotated together with the changing dial 7. The bottom surface of the cam 5, as shown in FIGS. 3B and 3C, forms a solid cam constituted by three surfaces. Specifically, the solid cam has a pushing-down surface 5b where the distance D from the top surface is relatively large, a reset surface 5c where the distance H from the top surface is relatively small, and two shifting surfaces 5d which smoothly connect the pushing-down surface 5b and the reset surface 5c together. The pushing-down surface 5b and the reset surface 5c are formed so that their center lines are aligned with each other. The angle $\alpha$ of the pushing-down surface 5b is a narrow angle, because the pushing-down surface 5b is sufficient if it has an area enough for the top of the actuating shaft 4a, 4b, or 4c to contact. On the other hand, the angle $\beta$ of the reset surface 5c is slightly greater than 120 degrees so that two of the actuating shafts 4a, 4b, and 4c can make contact with the opposite end portions of the reset surface 5c at the same time.

When a driver pin corresponding to a specific screw groove (large spline groove, for example) is selected by the screwdriver constructed as described above, the changing dial 7 is rotated while pushing down the changing switch 6. This causes the cam 5 to rotate, and therefore if the changing dial 7 is rotated until the pushing-down surface 5b of the cam 5 moves just above the actuating shaft 4a and then the changing dial 7 is released, the cam 5 will be fixed at that position and the actuating shaft 4a will be pushed down by the pushing-down surface 5b of the cam 5. The driver pin 1a is pushed down by the connecting rod 3a, then the spline of the driver pin 1a meshes with the spline groove of the insert 11, and the point portion of the driver pin 1a projects downward from the lower end of the cover 9. Therefore, the screwdriver of the present invention can be used as a screwdriver having the driver pin 1a. At this time, the driver pins 1b and 1c remain retracted into the cover 9, because the actuating shafts 4b and 4c have been pushed against the reset surface 5c of the cam 5 by means of the springs 2b and 2c. If the driver pin 1b is chosen and projected downward from the lower end of the cover 9 in the same way, the screwdriver of the present invention can be used as a screwdriver having the driver pin 1b. Likewise, if the driver pin 1c is chosen, the screwdriver can be used as a screwdriver having the driver pin 1c. Thus, the screwdriver according to the present invention can cope with small screws of various kinds where the shapes of the grooves in the screw heads are different from one another.

While the aforementioned embodiment has been described with relation to a screwdriver having three kinds of driver pins, it is obvious that the present invention is applicable to a screwdriver having driver pins of two, four, or more kinds. In addition, while the invention has been described with reference to a preferred embodiment thereof, the invention is not to be limited to the details given herein, but may be modified within the scope of the appended claims.

What is claimed is:

1. A screwdriver comprising:

a plurality of driver pins of different kinds where point portions of the driver pins are different from one another, each of the driver pins being provided with a plurality of longitudinal grooves on an outer surface thereof;

a plurality of first shafts connected to the driver pins through a first set of joints adapted to act universally, respectively;

a plurality of second shafts connected to the first shafts through a second set of joints adapted to act universally, respectively;

guide means for guiding up and down motion of the driver pins, the first shafts and the second shafts;

energizing means for urging the second shafts toward an upward position;

selecting means for selectively pushing down only one of the second shafts against the energizing means;

a housing for housing the driver pins, the first shafts, the second shafts, said guide means, the energizing means, and the selecting means, the housing being provided with a single hole located at a bottom end of the housing, the single hole allowing only one of the driver pins to pass through, and interior surfaces of the single hole being provided with a plurality of grooves which are engageable with the longitudinal grooves on the outer surface of each of the driver pins.

2. The screwdriver according to claim 1, wherein the guide means comprises:

interior walls of the housing where an upper portion of the housing is cylindrical in shape and a lower portion is conical in shape, and a bottom end of the lower portion being provided with the single hole; and a plate member provided at a place in the upper portion of the housing, the plate member being provided with a plurality of guide holes through which the second shafts are respectively guided upwardly and downwardly.

3. The screwdriver according to claim 1, wherein the energizing means comprises:

a plurality of springs for respectively urging the second shafts toward said upward position; and a stopper fixed at a place within the housing and provided with a plurality of guide holes, the stopper supporting the springs for urging the second shafts upwardly through the holes.

4. The screwdriver according to claim 1, wherein the energizing means comprises a plurality of springs for respectively urging the second shafts upwardly and the plate member supporting the springs for urging the second shafts upwardly through the guide holes.

5. The screwdriver according to claim 3, wherein the stopper comprises a member formed with the guide holes into which the second shafts are inserted and wherein the springs are held by material of the member which surrounds the guide holes.

6. The screwdriver according to claim 1, wherein the selecting means comprises:

a solid cam for pushing down only a selected one of the second shafts;

a changing dial rotatably mounted on the top of the housing for selecting said one second shaft; and a switch for engaging the solid cam with the changing dial.

7. The screwdriver according to claim 6, wherein the switch is movably provided in the changing dial, the switch being normally moved away from the solid cam, and when pushed down, the switch engaging with the solid cam so that the solid cam is rotated together with the changing dial.

8. The screwdriver according to claim 6, wherein the solid cam has a top surface and an under surface, the under surface having a first surface where a distance from said top surface is relatively large, a second surface where a distance from said top surface is relatively small, and a third surface which smoothly connects the first and second surfaces together, such that one of the second shafts is pushed down by the first surface while the remaining second shafts are held by the second surface.

9. The screwdriver according to claim 8, wherein the switch is movably provided in the changing dial, the switch being normally moved away from the solid cam, and when pushed down, the switch engaging with the solid cam so that the solid cam is rotated together with the changing dial.

10. A screwdriver comprising:

a housing:

a plurality of driver pins, each of the driver pins having a tip end which is different from the tip ends of the other driver pins;

a plurality of first shafts respectively connected to the driver pins through a first set of joints;

a plurality of second shafts respectively connected to the first shafts through a second set of universal joints;

guide means for slidably guiding a motion of the driver pins, the first shafts, and the second shafts;

biasing means for biasing the second shafts in a first direction;

selecting means for selecting one of the driver pins by selectively moving one of the second shafts against the biasing means; and supporting means for supporting and preventing a rotation of a selected one of the driver pins relative to the housing, wherein the housing contains the driver pins, the first shafts, the second shafts, said guide means, the biasing means, the selecting means, and the supporting means.

11. A screwdriver comprising:

a housing:

a plurality of driver pins of different kinds wherein tip ends of the driver pins are different from one another;

a plurality of first shafts connected to the driver pins through first joints, respectively;

a plurality of second shafts connected to the first shafts through second joints, respectively;

guide means for enabling a slidable guiding motion of the driver pins, the first shafts, and the second shafts;

biasing means for biasing the second shafts to a position in a first direction;

selecting means for selectively moving one of the second shafts against the biasing means, the selecting means comprising a solid cam for slidably moving one of the second shafts in a second direction which is opposite to the first direction; and supporting means for supporting and preventing a selected one of the driver pins from rotating relative to the housing, wherein the housing contains the driver pins, the first shafts, the second shafts, said guide means, the biasing means, the selecting means, and the supporting means.

12. The screwdriver according to claim 11, wherein the selecting means further comprises:

a changing dial rotatably mounted on an end of the housing; and a switch for engaging the solid cam with the changing dial.

13. The screwdriver according to claim 12, wherein the switch is movably provided in the changing dial, the switch being normally moved away from the solid cam, and when pushed down, the switch engaging with the solid cam so that the solid cam is rotated together with the changing dial.

14. The screwdriver according to claim 11, wherein the solid cam has a top surface and an under surface, the under surface comprising a first surface where a distance from said top surface to said first surface is relatively large, a second surface where a distance from said top surface to said first surface is relatively large, a second surface where a distance from said top surface to said second surface is relatively small, and a third surface which substantially smoothly connects the first and second surfaces together, so that one of the second shafts is pushed down by the first surface and the rest of the second shafts which are under the second surface remain held in said position under said bias acting in said first direction.

* * * * *